United States Patent [19]

Gdovichin

[11] 4,250,359

[45] Feb. 10, 1981

[54] SPEED SENSOR SWITCH

[75] Inventor: George G. Gdovichin, Ebensburg, Pa.

[73] Assignee: JAB Company, Incorporated, Ebensburg, Pa.

[21] Appl. No.: 48,997

[22] Filed: Jun. 15, 1979

[51] Int. Cl.[3] ..... H01H 35/10

[52] U.S. Cl. ..... 200/80 R; 318/793; 73/550

[58] Field of Search ..... 73/535–538, 73/545, 547, 550; 318/793; 200/80 R, 85 R, 243, 290, 61.45 R

[56] References Cited

U.S. PATENT DOCUMENTS

| | | | |
|---|---|---|---|
| 985,069 | 2/1911 | Schug | 200/80 R |
| 1,829,701 | 10/1931 | Cowardin | 73/547 |
| 2,300,708 | 11/1942 | Sleeter | 318/793 |
| 2,653,020 | 9/1953 | Stenson | 73/550 |
| 2,897,309 | 7/1959 | Randol | 200/80 R |
| 3,717,733 | 2/1973 | Berezansky | 200/80 R |

*Primary Examiner*—Gerald P. Tolin

*Attorney, Agent, or Firm*—Clarence A. O'Brien; Harvey B. Jacobson

[57] ABSTRACT

A pair of flyweights are mounted on a rotatable shaft and actuate a sleeve which is coaxially disposed on the shaft through a pair of radially extending control arms which are pivotally attached to the sleeve. The flyweights are biased inwardly by a pair of springs mounted on the control arms. On the opposite end of the sleeve is a bearing which provides a physical connection between the rotating sleeve and a non-rotating plate carrying a pair of movable contacts which cooperate with stationary contacts mounted on a stationary housing. The flyweights move outwardly upon rotation of the shaft against the action of the springs and move the sleeve axially along the shaft. The inward bias force of the springs decreases rapidly as the pivot connection of the control arms approaches the pivot connection of the flyweights causing an over center-type of action which results in an abrupt electrical connection between the stationary and the movable contacts. When the speed of the shaft is reduced, the flyweights move slowly inward until the pivot connection of the arms is spaced from the pivot connection of the flyweights at which time the spring action increases and causes an abrupt disconnection of the stationary and movable contacts.

9 Claims, 7 Drawing Figures

SPEED SENSOR SWITCH

BACKGROUND OF THE INVENTION

1. Field of the Invention

This invention relates to speed sensor switches of the flyweight actuated variety and especially to such switches which use an over centertype action to cause abrupt connection and disconnection of electrical contacts.

2. Description of Related Art

Speed sensitivity switches operated through centrifugal flyweights are often use to provide on/off switching control for motor, solenoid and similar control systems. In order for such a switch to be effective, it must be rugged, reliable and easy to operate.

Among centrifugally operated speed sensor switches suggested in the past is the switch shown in U.S. Pat. No. 985,069, issued Feb. 21, 1911 to Schug, which shows a plurality of flyweights mounted on a rotating shaft. The flyweights are connected to a collar which is urged forwardly upon radial outward movements of the weights. The collar urges a movable contact into engagement with a stationary contact. U.S. Pat. No. 2,846,539, issued Aug. 5, 1958 to Farr, shows a similar speed responsive switch wherein outward movement of flyweights is directly transformed into axial movement of a collar carrying movable contacts. U.S. Pat. No. 2,897,309, issued Jan. 28, 1959 to Randol, shows another speed responsive switch mechanism. The Randol mechanism includes a plurality of flyweights which move radially outward from a rotating shaft against the force of an axial aligned spring to separate the movable and stationary contacts of a switch. U.S. Pat. No. 3,717,733, issued Feb. 20, 1973 to Berezansky, shows a centrifugal switch wherein radial outward movement of a pair of flyweights causes axial movement of a sleeve through a linkage arrangement. The sleeve abuts against and forces movement of a switch arm containing a movable contact, forcing the switch arm to abruptly change position to an over center position and enter into electrical engagement with a stationary contact.

SUMMARY OF THE INVENTION

The present invention provides a pair of flyweights which are pivotally mounted to a rotating shaft through angled support arms. Each support arm includes one portion which is parallel to the shaft when in the rest position and another portion which is perpendicular to the shaft. An axially movable sleeve has movable switch contacts mounted thereon and is pivotally connected to a pair of radially extending control arms which pass through the parallel portions of the flyweight angled support arms. A spring is mounted between each radially extending control arm and its respective angled support arm to bias the flyweight inwardly toward the shaft. When the shaft rotates, the flyweight is thrown outwardly against the force of the spring and the sleeve moves axially along the rotating shaft. When the pivot point of the control arm approaches the pivot connection of the flyweight angled support arms, the component of the spring force which is effective in opposing the outward movement of the flyweights is greatly reduced and the flyweight advances abruptly moving the collar mounted movable contacts into electrical engagement with stationary contacts.

Accordingly, one object of the present invention is to provide a speed sensor switch wherein stationary and movable contacts are made and broken through a centrifugal actuation device which includes an over centertype action in order to cause rapid engagement and disengagement of the contacts in order to reduce arcing between the contacts thereby eliminating pitting and the wear of the contact surfaces.

A further object of the present invention is to provide a speed sensor switch having a minimum number of components, yet is rugged and reliable in operation.

Another object of the present invention is to provide a speed sensor switch which can easily be adjusted for producing switch actuation at any of a variety of speeds.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
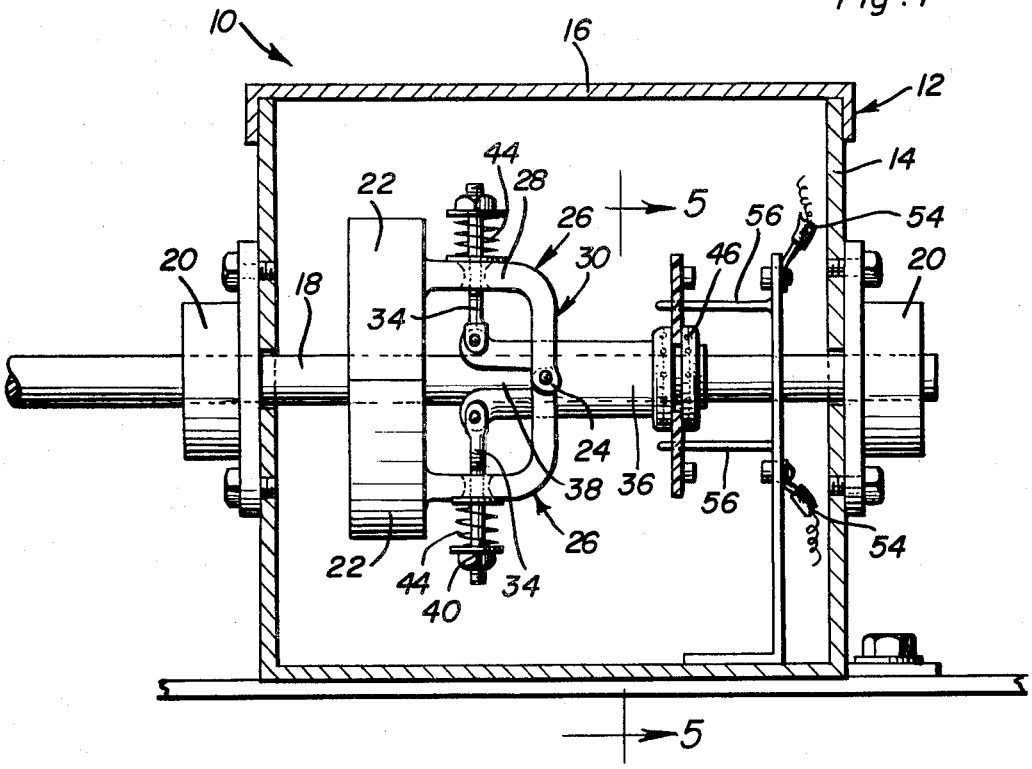
FIG. 1 is a side elevational view showing the speed sensor switch in its "off" position.

Now, with reference to the drawings, a speed sensor switch incorporating the details of the present invention and generally referred to by the reference numeral 10 will be described in detail. A housing 12 includes a base 14 and a removable cover 16 for allowing access to the interior of the housing which contains the functioning elements of the invention. A shaft 18 extends through the base 14 and is supported and journaled therein by a pair of bearings 20. The shaft 18 can be that of a motor, generator, pump or any other rotary device, the speed of which is to be controlled. In actual operation, shaft 20 is that of a roller conveyor using a clutch mechanism as disclosed in copending U.S. application Ser. No. 014,145. A pair of flyweights 22 are hingedly mounted to shaft 18 by pin 24 which passes through flyweight support arms 26. Each flyweight support arm 26 includes a first substantially flat portion 28 which is parallel to shaft 18 when the switch is in the "off" position as shown in FIG. 1. A second portion 30 is bifurcated and extends on each side of shaft 18. Portion 30 is disposed perpendicular to shaft 18 when the switch is in the position of FIG. 1. An aperture 32 is formed in the flat portion 28. Each aperture 32 has extending therethrough a control arm 34. Each control arm 34 is hingedly connected at one end to sleeve 36 which is mounted for axial movement on shaft 18. The sleeve 36 has a pair of diametrically opposed slots 38 formed therein, which slots surround pin 24. Threadedly attached to the end of each control arm 34 is a nut 40 and washer 42. Nuts 40 and washers 42 hold a coil spring 44 against the portion 28 surrounding aperture 32. In this manner, springs 44 bias the weights 22 against shaft 18 when the shaft is not rotating or rotating at a very slow angular velocity.

Figure 2:
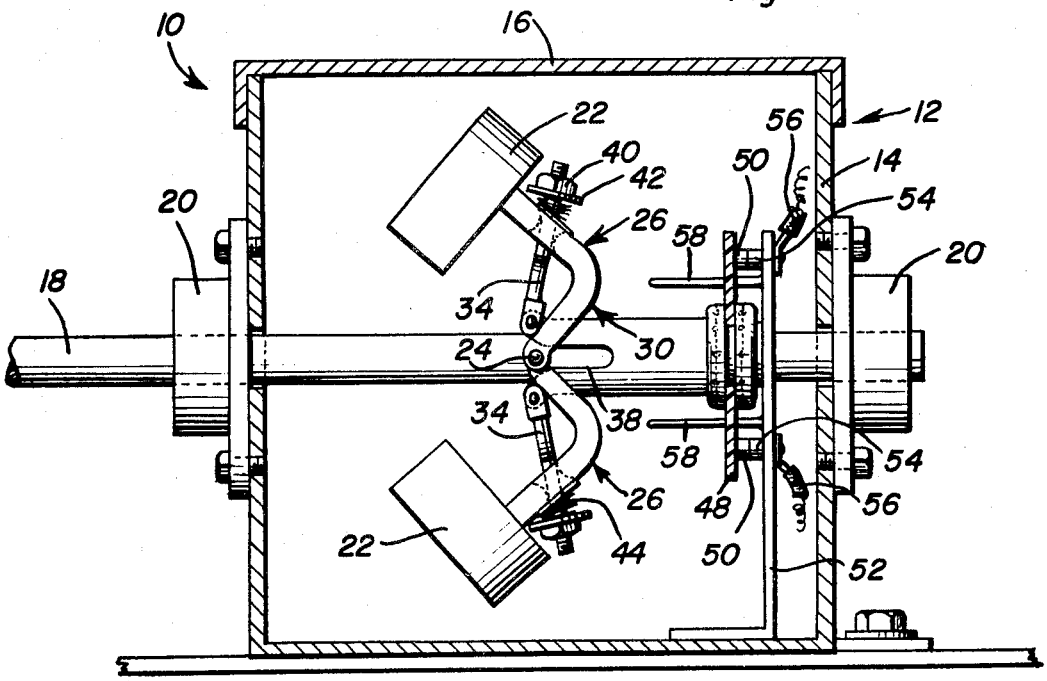
FIG. 2 is a side elevational view showing the speed sensor switch in its "on" position.
Figure 3:
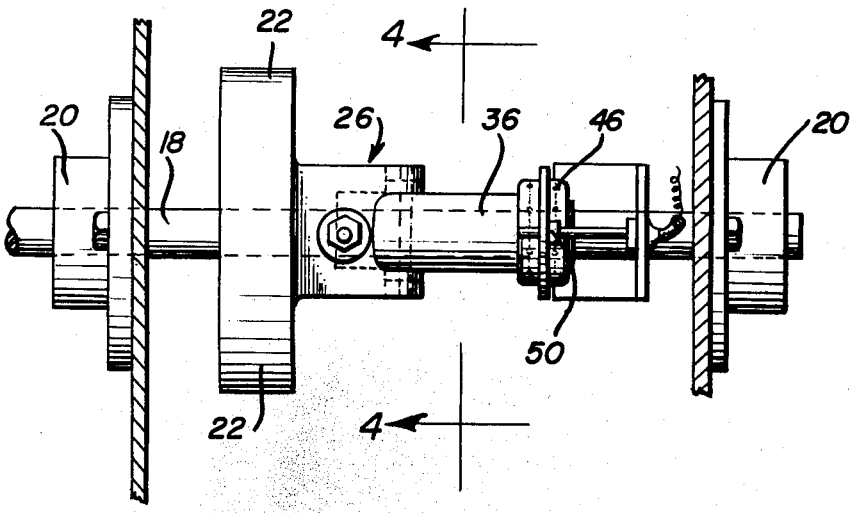
FIG. 3 is a top plan view of the speed sensor switch in its "off" position.
Figure 4:
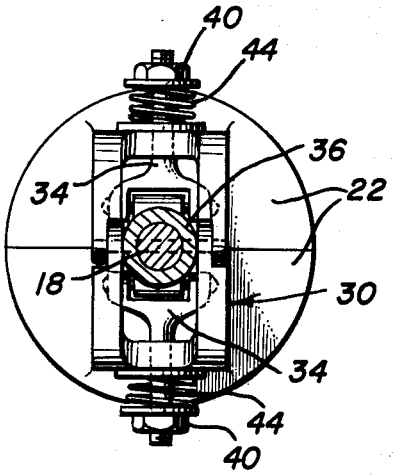
FIG. 4 is an end sectional elevational view taken substantially along a plane passing through section line 4—4 of FIG. 3.
Figure 5:
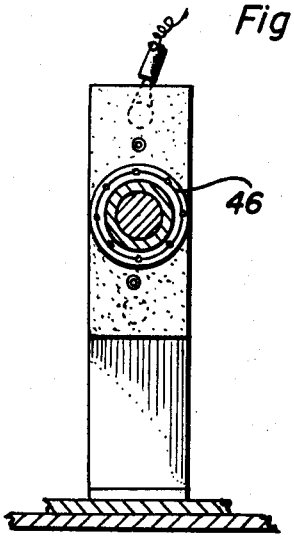
FIG. 5 is an end sectional elevational view taken substantially along a plan passing through section line 5—5 of FIG. 1.
Figure 6:
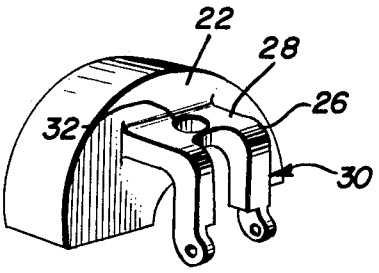
FIG. 6 is a perspective view of one of the flyweights of the invention.
Figure 7:
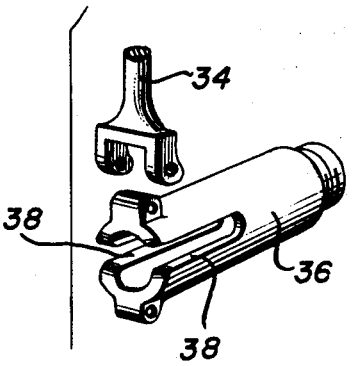
FIG. 7 is a perspective, exploded view of the sleeve of the present invention.

Obviously, as the angular velocity of the shaft 18 increases, the centrifugal force applied to weights 22 also increases urging these weights radially outward away from shaft 18 against the force produced by springs 44. At the same time, the angle of flat portion 28 begins to increase with respect to the shaft 18 and accordingly, the spring 44 together with control arms 34 move sleeve 36 radially along shaft 18. Now, since the component of the force produced by spring 44 which tends to return the weights 22 to their original position against shaft 18 is that component which is tangential to the arc through which aperture 32 travels, it becomes clear that as the pivot joint of control arms 34 approach pin 24, the component of force from spring 42 tangential to the arc is substantially reduced because the component of that force which is aimed at pin 24 is increased. Naturally, the additional radial movement accomplished by weights 22 under an additional increment of centrifugal force is substantially greater when the pivot joint of control arms 34 approach pin 24 than the radial movement accomplished under an equal increment of centrifugal force when the weights 22 are initially at rest as shown in FIG. 1. Accordingly, when the control arms 34 approach the position shown in FIG. 2, the sleeve 36 will experience an abrupt axial shift.

Mounted on the end of sleeve 36 is the inner race of bearing 46. The outer race of that bearing is attached to mounting plate 48 which mounts series connected movable contacts 50. A stationary contact mounting plate 52 is attached to base 14 and mounts stationary contacts 54 which are aligned with movable contacts 50. Each stationary contact 54 is connected to a wire 56 which place the contacts in series circuit with the electrical power supply for the device causing rotation of shaft 18. A pair of pins 58 extend outwardly from the mounting plate 52 in the direction of mounting plate 48 and enter apertures formed in plate 48. Pins 58 in cooperation with the apertures of plate 48 function to hold the plate 48 against rotation with respect to shaft 18 but allow the plate to move axially along shaft 18 in order to bring contacts 50 and 54 into electrical engagement.

As discussed above, a sudden abrupt axial shift of sleeve 36 is caused when shaft 18 reaches a predetermined angular velocity. This sudden abrupt shift carries movable contacts 50 into engagement with contacts 54 thus completely the circuit between wires 56. Any further increase in the speed of shaft 18 will have no affect on sleeve 36 as the sleeves progress axially along shaft 18 is stopped by contacts 54 and mounting plate 52. When shaft 18 experiences a deceleration, since the component of the force of springs 44 which causes a return of weights 22 has been reduced due to the new position of control arms 34, the initial deceleration will cause only a small change in the position of sleeve 36. However, once the pivot joints of control arms 34 are moved slightly past pin 24, the component of force produced by springs 44 which tends to return the weights 22 to their initial position increases causing the weights to return abruptly to their initial position thereby rapidly separating contacts 50 and 54. Thus, it can be seen that the desirable over center action causing abrupt engagement and disengagement of the switch contacts has been effected through the use of a minimum number of components. Furthermore, it can be seen that a speed setting adjustment can easily be effected by rotation of nuts 40 thereby producing a change in the effective length of control arms 34.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A speed responsive switch mechanism comprising: a rotatable shaft; a plurality of flyweights, each flyweight being connected to a support arm, each said support arm being pivotally connected to said shaft; a sleeve means disposed upon said shaft for axial movement along said shaft; movable contacts disposed upon said sleeve means; stationary contacts aligned with said movable contacts; and resilient means connected between said support arm and said sleeve means for causing axial movement of said sleeve means upon outward displacement of said flyweights; wherein said resilient means includes at least one control arm for each support arm, each said control arm being pivotally attached to said sleeve means and having a free end which passes through an aperture formed in a respective one of said support arms; a spring means mounted between each said free end and each said support arm for biasing each flyweight toward said shaft.

2. The apparatus of claim 1 and further including means for adjusting the effective length of each said control arm.

3. The apparatus of claim 2 wherein said means for adjusting the effective length of each said control arm includes a nut disposed on the free end of each said control arm for holding a respective said spring means between each said control arm and each said support arm, each said nut being threadedly engaged with each said free end.

4. The apparatus of claim 1 wherein said sleeve means includes a tubular member surrounding said shaft and including a plurality of slots extending from one end thereof surrounding the pivotal connection of said flyweight support arms.

5. The apparatus of claim 4 wherein the end of said sleeve opposite said slot includes a bearing means mounting said movable contacts.

6. A speed responsive switch mechanism comprising: a rotatable shaft; a plurality of flyweights, each flyweight being connected to a support arm, each said support arm being pivotally connected to said shaft; a sleeve means disposed upon said shaft for axial movement along said shaft; movable contacts disposed upon said sleeve means; stationary contacts aligned with said movable contacts; and resilient means connected between said support arm and said sleeve means for causing axial movement of said sleeve means upon outward displacement of said flyweights; wherein said resilient means includes at least one control arm for each support arm, each said control arm being pivotally attached to said sleeve means and having a free end which passes through an aperture formed in a respective one of said support arms; a spring means mounted between each said free end and each said support arm for biasing said flyweight toward said shaft; wherein said movable contacts are mounted upon the outer race of a bearing member, said bearing member having an inner race mounted on said sleeve means; and further including a pin means extending from said stationary contacts for inhibiting rotary motion of said movable contacts.

7. A speed responsive switch mechanism comprising:
a rotatable shaft;
at least one support arm pivotally mounted to said rotatable shaft;
a flyweight attached to said support arm;
a sleeve slidably mounted on said shaft for axial movement therealong;
movable contacts mounted on said sleeve;
stationary contacts mounted in operative relation to said movable contacts;
a control arm pivotally mounted to said sleeve at one end and containing a resilient means at the opposite end, said control arm passing through an aperture in said at least one support arm, said resilient means engaging said support arm for biasing said support arm toward said shaft, said support arm slidably engaging said control arm through said aperture whereby said support arm is capable of sliding along said control arm against the force of said resilient means.

8. The invention as defined in claim 7 wherein said resilient means includes a compression spring disposed around said control arm.

9. The invention as defined in claim 8 and further including a bearing member having an inner race mounted to said sleeve and an outer race mounting said movable contacts; and further including a pin means extending from said stationary contacts for inhibiting rotary motion of said movable contacts.

* * * * *